US007201014B2

(12) United States Patent
Hornung

(10) Patent No.: US 7,201,014 B2
(45) Date of Patent: Apr. 10, 2007

(54) ICE MAKER

(75) Inventor: Georg Hornung, Gaggenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/873,400

(22) Filed: Jun. 21, 2004

(65) Prior Publication Data

US 2004/0255606 A1 Dec. 23, 2004

Related U.S. Application Data

(63) Continuation of application No. PCT/EP02/13805, filed on Dec. 5, 2002.

(51) Int. Cl.
*F25C 1/00* (2006.01)

(52) U.S. Cl. ..... 62/347; 62/353

(58) Field of Classification Search ..... 62/74, 62/340, 347–348, 353
See application file for complete search history.

(56) References Cited

U.S. PATENT DOCUMENTS 3,380,261 A * 4/1968 Hendrix et al. ..... 62/138
3,418,823 A * 12/1968 Vivai ..... 62/138
3,796,063 A * 3/1974 Wulke et al. ..... 62/340
4,055,053 A 10/1977 Elfving et al.
4,207,750 A * 6/1980 Simkens ..... 62/138
4,363,220 A * 12/1982 Ripley ..... 62/138
5,012,655 A * 5/1991 Chatterton ..... 62/340
5,199,270 A * 4/1993 Simkens ..... 62/73
5,405,052 A * 4/1995 Sawyer, III ..... 222/64
5,555,743 A * 9/1996 Hatanaka ..... 62/347

FOREIGN PATENT DOCUMENTS

| | | |
|---|---|---|
| DE | 40 20 128 A1 | 1/1992 |
| EP | 0 227 611 B1 | 7/1987 |
| WO | 00/66956 | 11/2000 |

* cited by examiner

*Primary Examiner*—William E. Tapolcai
(74) *Attorney, Agent, or Firm*—Russell W. Warnock; Craig J. Loest

(57) ABSTRACT

An ice-maker for producing transparent ice cubes has a refrigerating assembly, an ice cube making tub, and a feeding tank for filling the ice cube making tub in a common housing. The ice cube making tub is movable between a first position, wherein cooling fingers of the refrigerating assembly engage into the ice cube making tub, and a second position away from the cooling fingers.

19 Claims, 2 Drawing Sheets

ICE MAKER

CROSS-REFERENCE TO RELATED APPLICATION

This application is a continuation, under 35 U.S.C. § 120, of copending international application No. PCT/EP02/13805, filed Dec. 5, 2002, which designated the United States; this application also claims the priority, under 35 U.S.C. § 119, of German patent application No. 101 62 917.6, filed Dec. 20, 2001; the prior applications are herewith incorporated by reference in their entirety.

BACKGROUND OF THE INVENTION

Field of the Invention

The present invention relates to ice makers and, particularly, to a unit for making ice cubes.

In private households, ice cubes are generally made with the aid of ice-cube trays that have a multiplicity of compartments which are filled with water and then frozen in a freezer. The freezing operation continues from the outside inward. The initially frozen outer layers of an ice cube are thereby subjected to increasing levels of stress as the freezing operation continues into the interior and thus results in an increase in volume. This stressing prevents a homogeneous, clear mass of ice from being produced; instead, the mass of ice is rendered opaque by a multiplicity of tiny bubbles and streaks.

In a commercial hospitality setting, use is therefore frequently made of so-called clear-ice makers, which supply the consumer with more appealing, crystal-clear ice cubes. For this purpose, use is made of a freezing operation which continues from the inside to the outside and in which cooling fingers that are cooled to below 0° C. are submerged in a water basin, with the result that the ice cubes form on these cooling fingers.

Conventional clear-ice makers, described for example in German published patent application DE 40 20 128 A1, constitute high-outlay units for commercial use. They are configured for fixed connection to a water pipe and they operate more or less fully automatically.

Such units are not viable for use in private households on account of the amount of space they require, their cost and their production capacity. The latter far exceeds the requirements of a private household.

SUMMARY OF THE INVENTION

It is accordingly an object of the invention to provide an ice maker, which overcomes the above-mentioned disadvantages of the heretofore-known devices and methods of this general type and specifies a unit for making pieces of ice which is also suitable for use in private households.

With the foregoing and other objects in view there is provided, in accordance with the invention, an ice-making unit, comprising:

a housing;

a cooling subassembly having cooling fingers;

an ice-making tray movably disposed in the housing between a first position, in which the cooling fingers of the cooling subassembly project into the ice-making tray, and a second position, in which the cooling fingers are remote from the ice-making tray;

a supply tank for filling the ice-making tray commonly integrated with the ice-making tray in the housing.

In light of the fact that the supply tank is integrated in the unit, allows the unit to be operated at any desired location, regardless of whether or not a water supply is available. Moreover, it is possible for the unit to be conveniently stowed away in a cupboard when it is not in use and, if required, to be brought out and set in operation without initial high-outlay connection to a water pipe having to be made.

An ice-cube storage container for finished pieces of ice is accommodated in the housing, preferably beneath the ice-making tray. The finished pieces of ice can drop in without any manual contact. This accommodating container is preferably designed as a drawer, with the result that it can be drawn out of the housing, together with its contents, in order to allow removal. Using a drawer also allows a more compact construction of the housing than if the finished ice cubes have to be removed, in the conventional manner, through a flap from an accommodating container which is fixed in the housing.

In the case of a particularly compact construction, it is possible for the ice-making tray itself to serve as accommodating container for finished pieces of ice.

The unit is preferably designed both for operation by a mains socket and for mains-independent operation, in particular by a motor vehicle battery or a marine battery.

Other features which are considered as characteristic for the invention are set forth in the appended claims.

Although the invention is illustrated and described herein as embodied in a ice-cube maker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
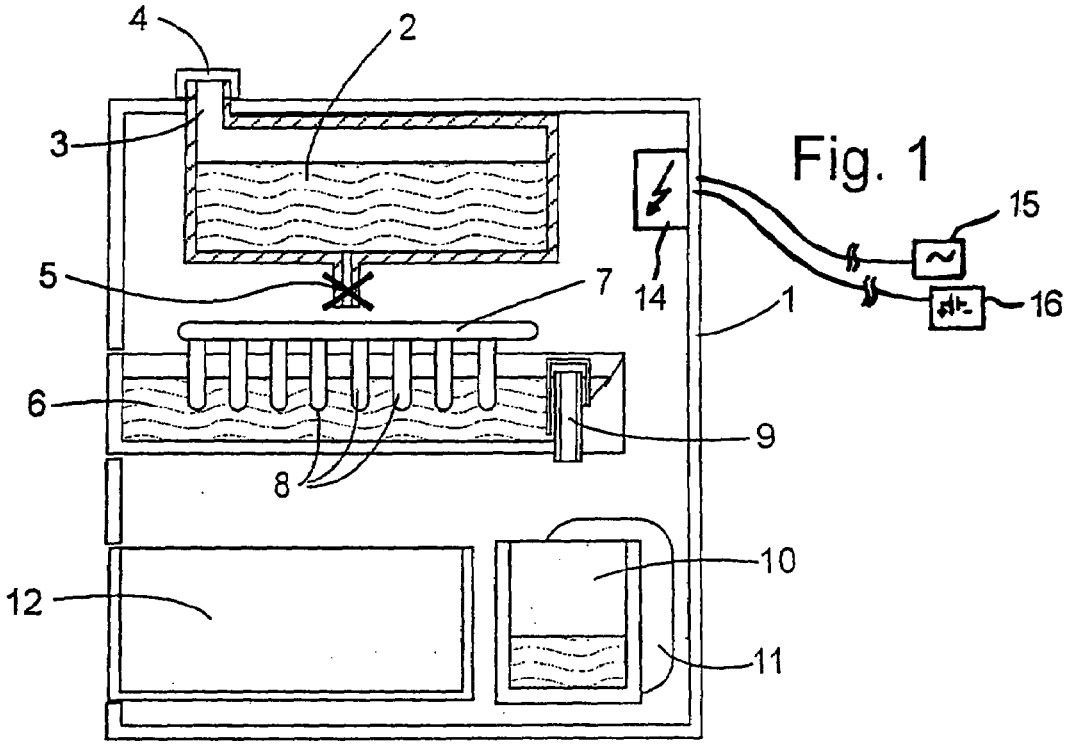
FIG. 1 shows a schematic section through an ice maker according to the invention, illustrated in a state as it begins its ice-making operation.

Referring now to the figures of the drawing in detail and first, particularly, to FIG. 1 thereof, a supply tank 2 for clean water is accommodated in the top part of a housing 1 of the ice maker. A filler nozzle 3 with the removable cover 4 is accessible on the top side of the housing 1. A valve 5 is disposed on the base of the supply tank 2 for selectively feeding water into an ice-making tray 6. The valve 5 can be actuated by a user from outside the housing 1; alternatively, the valve 5 is an automatically actuated valve which is closed whenever the movable ice-making tray 6 is not located precisely in its ice-cube-making position shown in the figure and which, when the ice-making tray 6 is located in this position shown, is open as long as the water level in the tray 6 is below the desired level shown in the figure. The valve 5 is closed—for instance with the aid of a non-illustrated float—when the desired level is reached.

The unit contains a conventional refrigerating machine with an evaporator 7 which extends above the ice-making tray 6 and bears cooling fingers 8 which project downward into the tray.

A siphon 9 is arranged in the vicinity of a periphery of the ice-making tray 6, in this case of the periphery directed toward the rear side of the housing. The siphon, or overflow pipe, becomes active, inter alia, when the valve 5 is functionally disrupted, and empties the contents of the ice-making tray 6 into a residual-water tank 10, which is located therebeneath, if the water level in the ice-making tray 6 rises above the tip of the siphon 9, i.e., its overflow level.

In addition to the residual-water tank 10, a compressor 11 of the refrigerating machine and a drawer 12 for finished ice cubes are also accommodated in a bottom region of the housing 1. The unit may be supplied from selective power sources. In a preferred embodiment, the power supply 14 of the ice-making unit can be connected to a mains supply 15 (indicated with an a.c. current symbol) or to a d.c. source 16, such as a vehicle battery or the like. In the latter case, the unit is entirely mobile.

Figure 2:
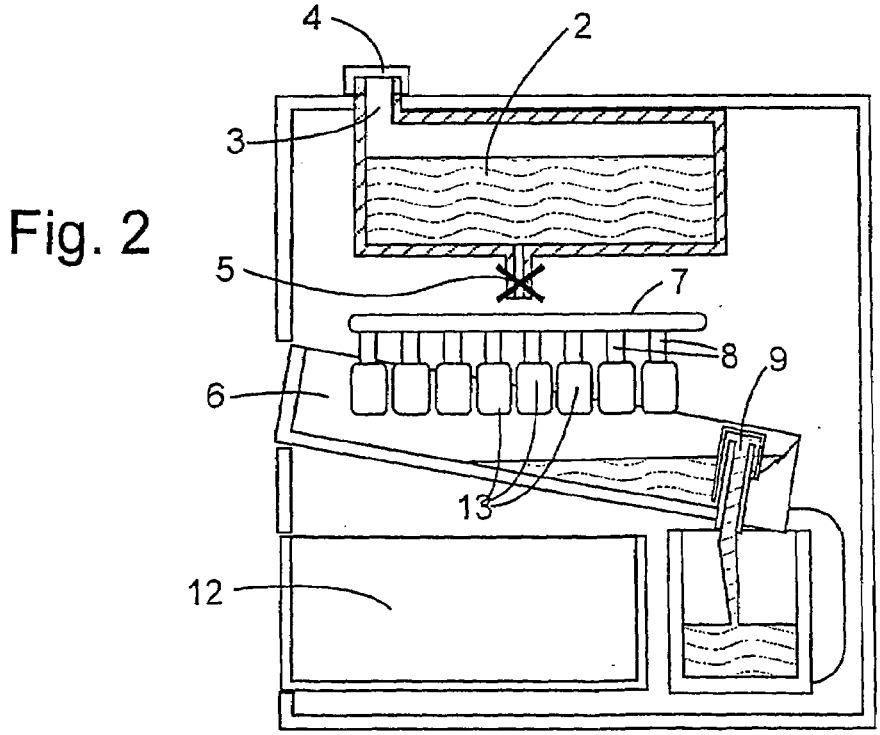
FIG. 2 shows a schematic section through the ice-cube maker in an operating phase just before the finished ice cubes are removed.

If the ice-making tray 6, as is shown in FIG. 1, is filled with water and the refrigerating machine is set in operation, water begins to freeze at the tips of the cooling fingers 8 and, once the unit has been running for a sufficient period of time, forms clear ice cubes on the tips of the cooling fingers 8. In order for these ice cubes to be removed, in the first instance, as is shown in FIG. 2, the rear region of the ice-making tray 6 is lowered. The water level in this region thus rises above the overflow siphon 9 and the non-frozen residual water flows off through the siphon 9 into the residual-water tank 10. The ice cubes 13, meanwhile, remain hanging on the cooling fingers 8.

Figure 3:
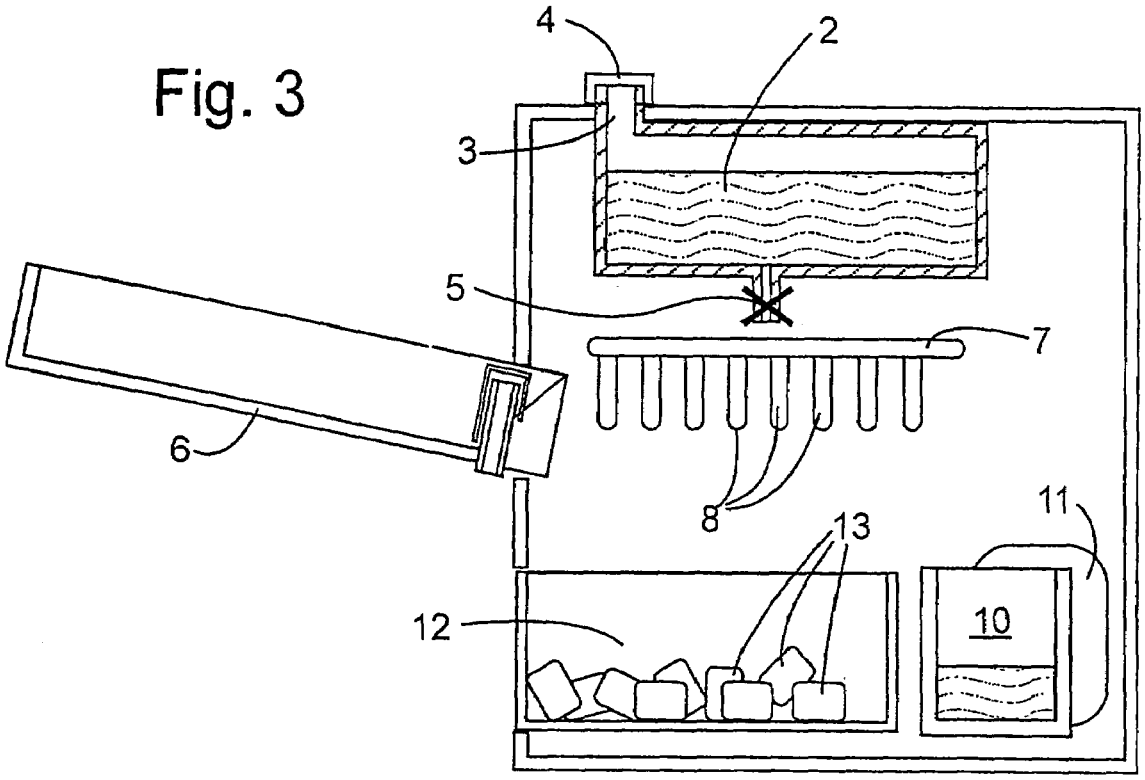
FIG. 3 shows a section through the unit toward the end of an operating phase, with ice cubes which are ready for removal.

Once the residual water has run out into the residual-water tank 10, the ice-making tray 6 can be drawn out of the housing 1, similar to a drawer, as is shown in FIG. 3. At the same time, the cooling fingers 8 are heated in order to release the ice cubes 13 produced thereon. These ice cubes thus drop into the drawer 12 located beneath the evaporator 7. The ice-making tray 6 can then be pushed back into its place shown in FIG. 1 and refilled with water from the supply tank 2, while the finished ice cubes 13 are available for removal in the drawer 12.

In the case of a simplified, even more compact configuration of the ice-cube maker according to the invention, it is possible to dispense with the drawer 12; instead, the ice-making tray 6 is utilized for making ice cubes in its position shown in FIG. 1 and, once the ice cubes have been made, is left in the lowered position, which is shown in FIG. 2. By virtue of the cooling fingers 8 being heated, the ice cubes drop into the tray 6 and can be removed by virtue of the tray 6 being drawn out.

I claim:

1. An ice-making unit, comprising:

a housing;

a cooling subassembly having cooling fingers;

an ice-making tray movably disposed in said housing between a first position, in which said cooling fingers of said cooling subassembly project into said ice-making tray, and a second position, in which said cooling fingers are remote from said ice-making tray and residual non-frozen water flows out of said ice-making tray through a siphon; and a supply tank integrated in said housing and fluidically connected to said ice-making tray for filling the ice-making tray.

2. The unit according to claim 1, which further comprises an ice-cube container for accommodating therein pieces of ice disposed in said housing underneath said ice-making tray.

3. The unit according to claim 1, wherein said ice-making tray is configured for accommodating therein finished pieces of ice.

4. The unit according to claim 2, wherein said ice-cube container is a drawer.

5. The unit according to claim 1 configured for selective operation by mains power or battery power.

6. The unit according to claim 1 configured for selective operation by mains power or from a vehicle battery.

7. The unit according to claim 1, including a residual water tank into which the residual non-frozen water flows.

8. An ice-making unit, comprising:

a housing;

a cooling subassembly having cooling fingers;

an ice-making tray movably disposed in said housing between a first position, in which said cooling fingers of said cooling subassembly project into said ice-making tray, and a second position, in which said cooling fingers are remote from said ice-making tray and residual non-frozen water flows out of said ice-making tray through a siphon; and a water supply tank for filling said ice-making tray with water to a desired level, said water supply tank commonly integrated with said ice-making tray in said housing.

9. The unit according to claim 8, including an ice-cube container for accommodating therein pieces of ice from said ice-making tray disposed in said housing underneath said ice-making tray.

10. The unit according to claim 9, wherein said ice-cube container is configured for accommodating therein finished pieces of ice, said ice-making tray formed as a drawer and a heater for heating said finished pieces of ice to allow said finished pieces of ice to fall into said ice-cube container.

11. The unit according to claim 10, wherein said ice-cube container is a drawer permitting said ice-cube container drawer to be removed with said finished pieces of ice from said housing.

12. The unit according to claim 8, wherein said ice-making tray is configured for accommodating therein finished pieces of ice, and a heater for heating said finished pieces of ice to allow said finished pieces of ice to fall into said ice-cube container.

13. The unit according to claim 8 configured for selective operation by at least one of a mains power source or a battery power source.

14. An ice-making unit, comprising:

a housing;

a cooling subassembly having cooling fingers;

an ice-making tray movably disposed in said housing between a first position, in which said cooling fingers of said cooling subassembly project into said ice-making tray, and a second position, in which said cooling fingers are remote from said ice-making tray and residual non-frozen water flows out of said ice-making tray;

a water supply tank fluidically connected to said ice-making tray for filling said ice-making tray with water to a desired level, said water supply tank being commonly integrated with said ice-making tray in said housing;

a residual water tank into which the residual non-frozen water flows in said second position of said ice-making tray;

an ice-cube drawer disposed in said housing underneath said ice-making tray for accommodating therein pieces of ice from said ice-making tray, said ice-cube drawer being at least partially removable from said housing; and a heater for heating said finished pieces of ice to allow said finished pieces of ice to fall into said ice-cube drawer.

15. The unit according to claim 14, further comprising a power supply connected to said cooling subassembly and to said ice-making tray for supplying electrical power thereto, said power supply being selected from a mains power and battery power.

16. The unit according to claim 15, wherein said battery power is from a vehicle battery.

17. The unit according to claim 14, wherein said ice-making tray is one of removable from said housing or at least sufficiently removably to allow said finished pieces of ice to drop free thereof.

18. The unit according to claim 14, further comprising a residual water tank into which said residual non-frozen water flows.

19. An ice-making unit, comprising:

a housing;

a cooling subassembly having cooling fingers;

an ice-making tray movably disposed in said housing between a first position, in which said cooling fingers of said cooling subassembly project into said ice-making tray, and a second position, in which said cooling fingers are remote from said ice-making tray and residual non-frozen water flows out of said ice-making tray, said ice-making tray being formed as a drawer and being removable from said housing or at least sufficiently to allow said finished pieces of ice to drop free thereof; a water supply tank for filling said ice-making tray with water to a desired level, said water supply tank commonly integrated with said ice-making tray in said housing; an ice-cube container for accommodating therein pieces of ice from said ice-making tray disposed in said housing underneath said ice-making tray; and a heater for heating said finished pieces of ice to allow said finished pieces of ice to fall into said ice-cube container.

* * * * *

UNITED STATES PATENT AND TRADEMARK OFFICE

CERTIFICATE OF CORRECTION

PATENT NO. : 7,201,014 B2
APPLICATION NO. : 10/873400
DATED : April 10, 2007
INVENTOR(S) : George Hornung It is certified that error appears in the above-identified patent and that said Letters Patent is hereby corrected as shown below:

The title page, item [30] under Foreign Application Priority Data insert the following:

Foreign Applicaion Priority Data

Dec. 20, 2001 (DE) .....101 62 917.6

Signed and Sealed this

Twenty-second Day of May, 2007

JON W. DUDAS
*Director of the United States Patent and Trademark Office*